US005511841A

United States Patent [19]

Allen

[11] Patent Number: 5,511,841

[45] Date of Patent: Apr. 30, 1996

[54] GOLF BALL RETRIEVER DEVICE AND METHOD OF USING SAME

[76] Inventor: Donavan J. Allen, 101 Cason St., Taylors, S.C. 29687

[21] Appl. No.: 283,037

[22] Filed: Jul. 29, 1994

[51] Int. Cl.[6] ..... A63B 47/02

[52] U.S. Cl. ..... 294/66.1; 294/19.2

[58] Field of Search ..... 294/19.2, 66.1; 56/8, 400.11, 400.12; 273/32 B, 32 F

[56] References Cited

U.S. PATENT DOCUMENTS

| | | | |
|---|---|---|---|
| 97,420 | 11/1869 | Mayhew | 56/8 |
| 691,843 | 1/1902 | Craig | 56/400.11 |
| 1,014,250 | 1/1912 | Norman | 56/400.11 |
| 2,738,214 | 3/1956 | Zimmers | 294/19.2 |
| 3,276,807 | 10/1966 | Ward | 294/66.1 |
| 3,756,644 | 9/1973 | Rydberg | 294/66.1 |
| 4,635,987 | 1/1987 | Hurtgam | 294/19.2 |
| 4,774,804 | 10/1988 | Sands | 56/8 |
| 4,828,690 | 5/1989 | Montez | 56/400.11 |
| 4,984,836 | 1/1991 | Redding | 294/66.1 |
| 5,246,260 | 9/1993 | Racicot | 294/19.2 |

*Primary Examiner*—Dean Kramer
*Attorney, Agent, or Firm*—Dority & Manning

[57] ABSTRACT

A golf ball retriever device and method of using same for recovering golf balls from a water hazard. The device comprises an open frame portion having a pair of longitudinal frame members and a plurality of interconnecting ball catching members. The ball catching members are spaced to entrap golf balls while allowing smaller objects in the water hazard to pass through. The device further includes an extension portion having a tie end located forwardly of the open frame portion. A tether cord of a predetermined length is attached to the tie end of the extension portion. After being thrown into the water hazard to a location beyond the golf ball to be retrieved, the tether cord is pulled so that the golf ball is entrapped and thereby recovered. The extension portion helps the device maintain a correct orientation while it is pulled without digging into the soft bottom of the water hazard. Preferably, the extension portion is also removable so that the device can be made compact for storage.

15 Claims, 7 Drawing Sheets

GOLF BALL RETRIEVER DEVICE AND METHOD OF USING SAME

BACKGROUND OF THE INVENTION

The present invention relates generally to the game of golf. More particularly, the present invention relates to a device and method for recovering golf balls which had been inadvertently hit into water hazards and the like.

A typical golf course is constructed having a number of hazards which must be overcome during play. Among these hazards, water hazards, such as small ponds, are a particular source of frustration for many golfers. This is because golf balls hit into a water hazard are often unrecoverable. As a result, a golfer is often forced to use a new golf ball when another shot over the water hazard is attempted.

Various devices have been provided in the past to facilitate recovery of golf balls from water hazards. For example, various arrangements have been constructed having a cup mounted on the end of a pole. Often, the pole includes a plurality of telescopic segments which permit the device to be lengthened for use and shortened for storage in a golf bag. To retrieve a golf ball with a telescopic retriever of this type, the golfer simply stands on the bank of the water hazard and scoops up the golf ball with the cup.

While such devices have been somewhat useful, they have also suffered from a number of distinct disadvantages. For example, many water hazards are of a size such that golf balls will often be located beyond the reach of a telescopic retriever device. Furthermore, as the distance to the golf ball increases, it becomes increasingly difficult for the golfer to precisely scoop the golf ball.

Devices of this type have also generally been limited to retrieving only one golf ball at a time. Often, however, it is necessary or desirable to retrieve a large number of golf balls which have collected in a water hazard over a period of time. For example, golf course management will often desire to collect these balls so that they may be resold on the secondary market. In the past, scuba divers have often been employed to swim in the water hazards and manually retrieve golf balls for this purpose.

SUMMARY OF THE INVENTION

The present invention recognizes and addresses the foregoing disadvantages, and others of prior art constructions and methods.

Accordingly, it is an object of the present invention to provide an improved golf ball retriever device.

It is a particular object of the present invention to provide a golf ball retriever device which can easily recover golf balls from a water hazard which are located a relatively significant distance from the bank of the water hazard.

It is a more particular object of the present invention to provide an improved golf ball retriever device which is compact and may be easily stored in a golf bag.

It is also an object of the present invention to provide a golf ball retriever device which is capable of recovering a plurality of golf balls at a time.

It is also an object of the present invention to provide an improved method of retrieving a golf ball from a water hazard.

Some of these objects are achieved by a golf ball retriever device for recovering golf balls of a predetermined diameter from hazard situations. The device comprises an open frame portion having a pair of longitudinal frame members extending substantially in parallel in a longitudinal direction such that the open frame portion has a greater extent in the longitudinal direction and a lesser extent in a transverse direction. A plurality of ball catching members which are spaced by a spacing less than the predetermined diameter of the golf balls are attached to the open frame portion. The device further includes an extension portion having a tie end located forwardly of the open frame portion substantially at a predetermined distance from a midpoint location of the longitudinal and transverse directions. A tether cord of a predetermined length is attached to the tie end of the extension portion.

In presently preferred embodiments, the extension portion comprises a longitudinal extension member attached to a cross member extending between the longitudinal frame members. Preferably, the tie end of the longitudinal extension member defines a loop to facilitate attachment of the tether cord thereto. To permit the device to be completely folded for storage, the longitudinal extension member may define threads on an end opposite the tie end for engagement with a threaded bore defined in the cross member.

In an exemplary construction, the plurality of ball catching members are arcuate in shape and extend in the transverse direction between the longitudinal frame members. Preferably, the open frame portion further includes a pair of transverse frame members located at respective ends of the longitudinal frame members.

The predetermined distance at which the extension member is located from the midpoint of the longitudinal and transverse direction is preferably at least eight (8) inches. Furthermore, such predetermined distance is generally no greater than ten (10) inches in presently preferred embodiments. The predetermined length of the tether cord may preferably be at least twenty-five (25) feet.

In some exemplary embodiments, the open frame portion is constructed as a pair of generally U-shaped members having a closed end and an open end. In such embodiments, the cross member may be pivotally connected across the open end of each of the U-shaped members. Thus, the U-shaped members may remain folded for compactness when not in use, and unfolded during use to form the open frame portion. In one preferred configuration, the cross member is constructed having at least one tab portion integrally mounted thereon. Such tab portions may be abutted by the open end of the U-shaped members when unfolded to prevent the open frame portion from undesirably pivoting about the cross member as a unit.

Other objects of the invention are achieved by a method of retrieving a golf ball in a water hazard from a selected location on a bank of the water hazard. First, the method comprises providing a golf ball retriever device such as that described herein. Second, a distal end of the tether cord is secured at the selected location on the bank of the water hazard, such as by being held by a golfer. Next, the open frame portion of the golf ball retriever device is tossed into the water hazard to a location such that the golf ball is between the open frame portion and the selected location on the bank of the water hazard. Finally, the open frame portion is pulled utilizing the tether cord such that the golf ball is entrapped and drawn to the selected location on the bank of the water hazard. Other objects, features and aspects of the present invention are discussed in greater detail below.

BRIEF DESCRIPTION OF DRAWINGS

A full and enabling disclosure of the present invention, including the best mode thereof, to one of ordinary skill in the art, is set forth more particularly in the remainder of the specification, including reference to the accompanying figures, in which.

Figure 1:
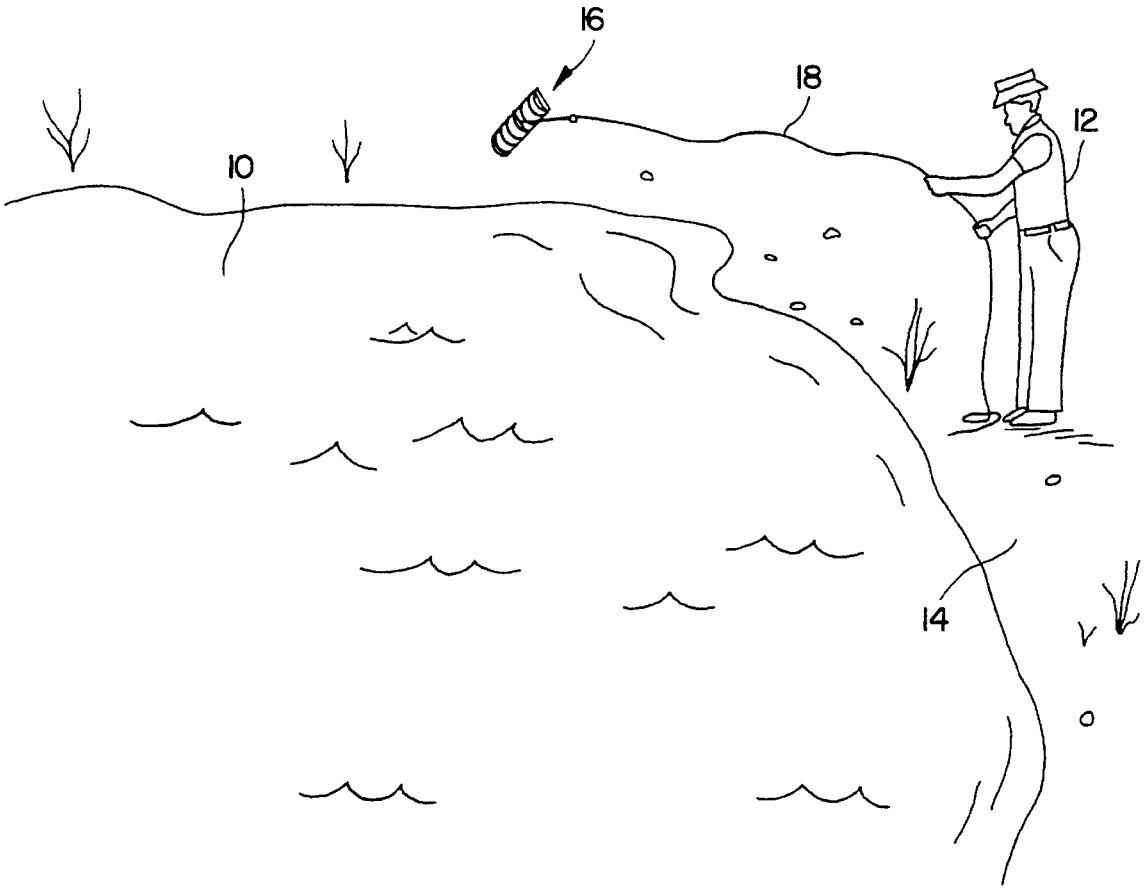
FIG. 1 is a perspective view illustrating a golfer retrieving a golf ball from a water hazard according to the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

Referring now to FIG. 1, a method of recovering a golf ball from a water hazard, such as that indicated generally at 10, may be easily described. As shown, a golfer 12 or other individual desiring to recover a golf ball is standing at a selected location along the bank 14 of water hazard 10. From this location, golfer 12 tosses a golf ball retriever device indicated generally at 16 into water hazard 10 to a location beyond the golf ball to be recovered. As device 16 is tossed, golfer 12 holds the distal end of a tether cord 18 as shown. Preferably, tether cord 18 has a length of at least twenty-five (25) feet.

Figure 2:
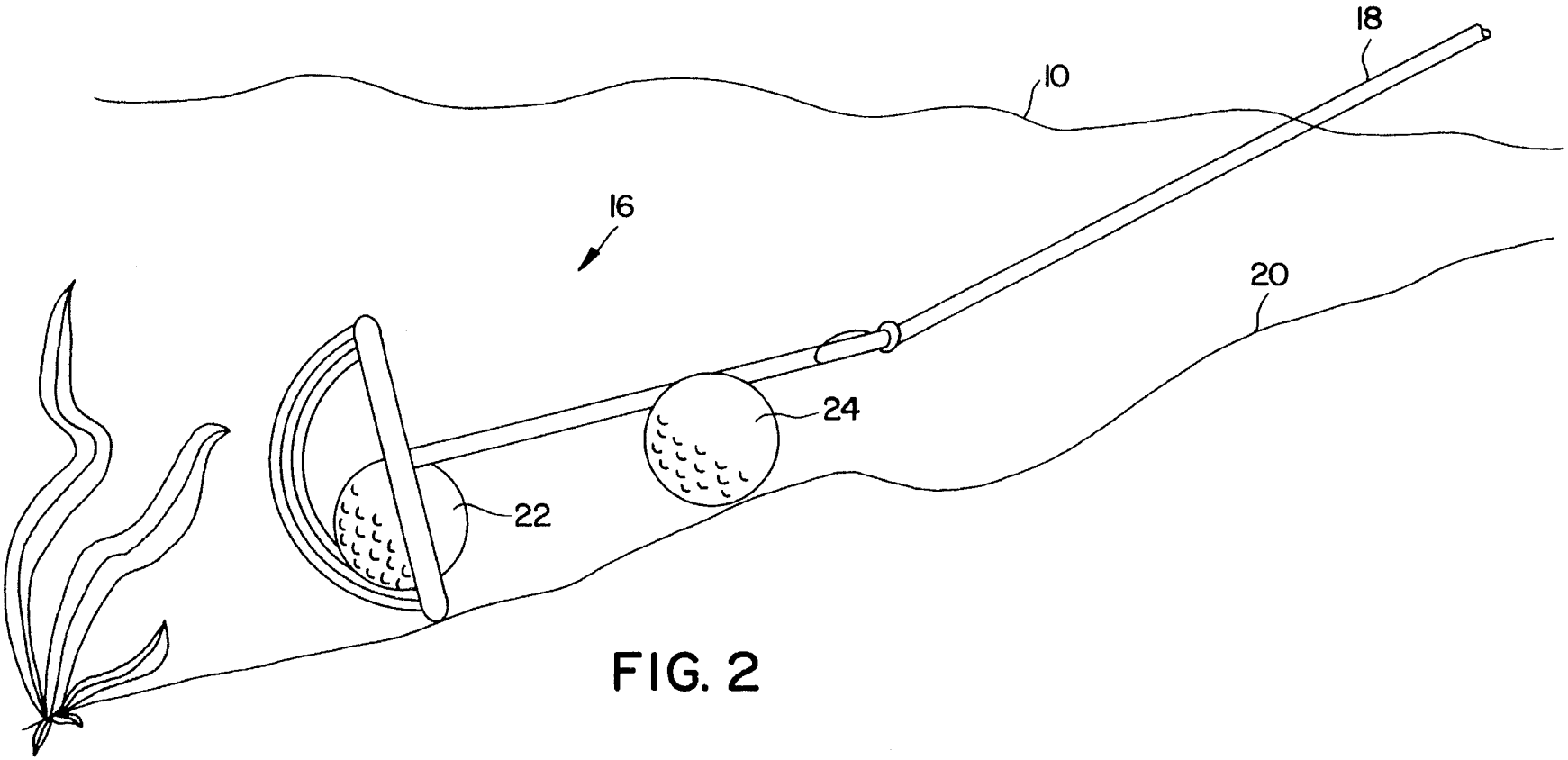
FIG. 2 is a side elevation of a golf ball retriever device constructed in accordance with the present invention as it may appear in use.

After being tossed into water hazard 10, device 16 sinks to the bottom 20 thereof, as can be most easily seen in FIG. 2. The golfer 12 then begins pulling device 16 back to the selected location on bank 14 utilizing tether cord 18. As a result, a portion of device 16 will be dragged along the bottom 20. In this manner, golf balls, such as golf ball 22, will be captured in device 16 and drawn back to golfer 12. Additional golf balls, such as golf ball 24, which may be in the path along with device 16 is pulled, will also be entrapped and recovered. It will be appreciated that device 16 should preferably have sufficient weight so that it generally remains on bottom 20 as it is pulled. In presently preferred embodiments, device 16 is constructed of metal to provide such weight, as well as durability.

Figure 3:
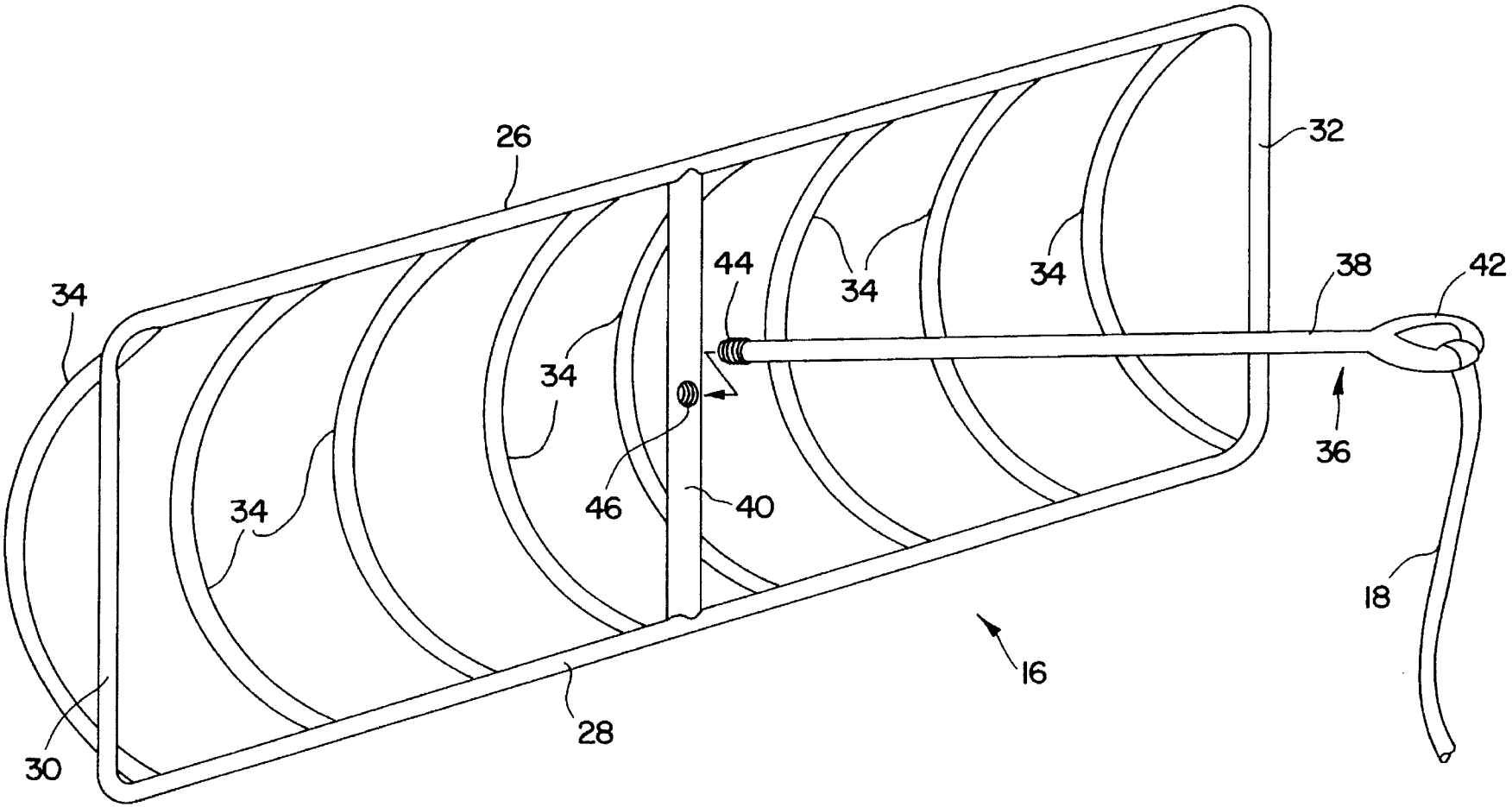
FIG. 3 is a perspective view of one exemplary embodiment of a golf ball retriever device constructed in accordance with the present invention.
Figure 4:
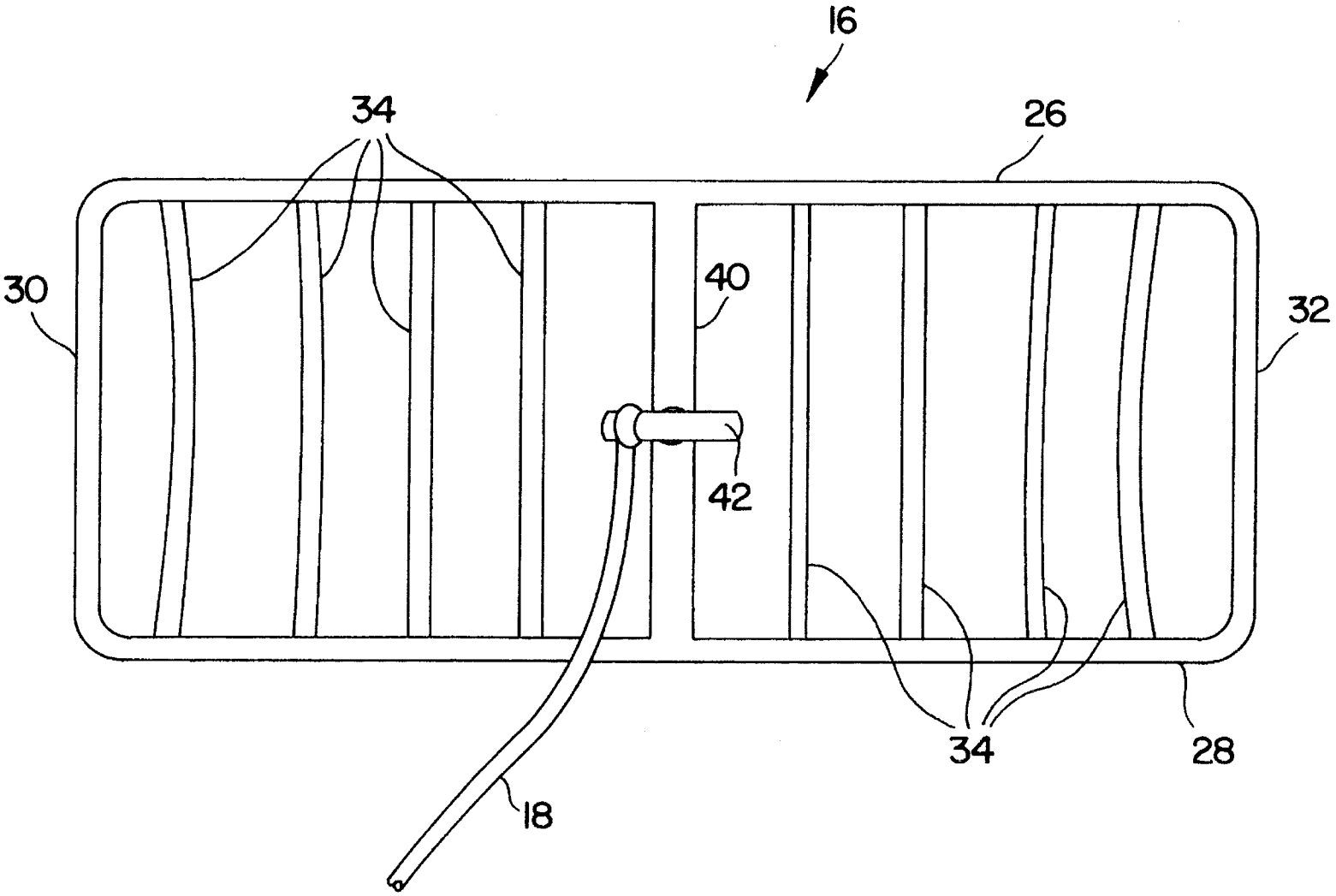
FIG. 4 is a front elevation of the embodiment of FIG. 3.
Figure 5:
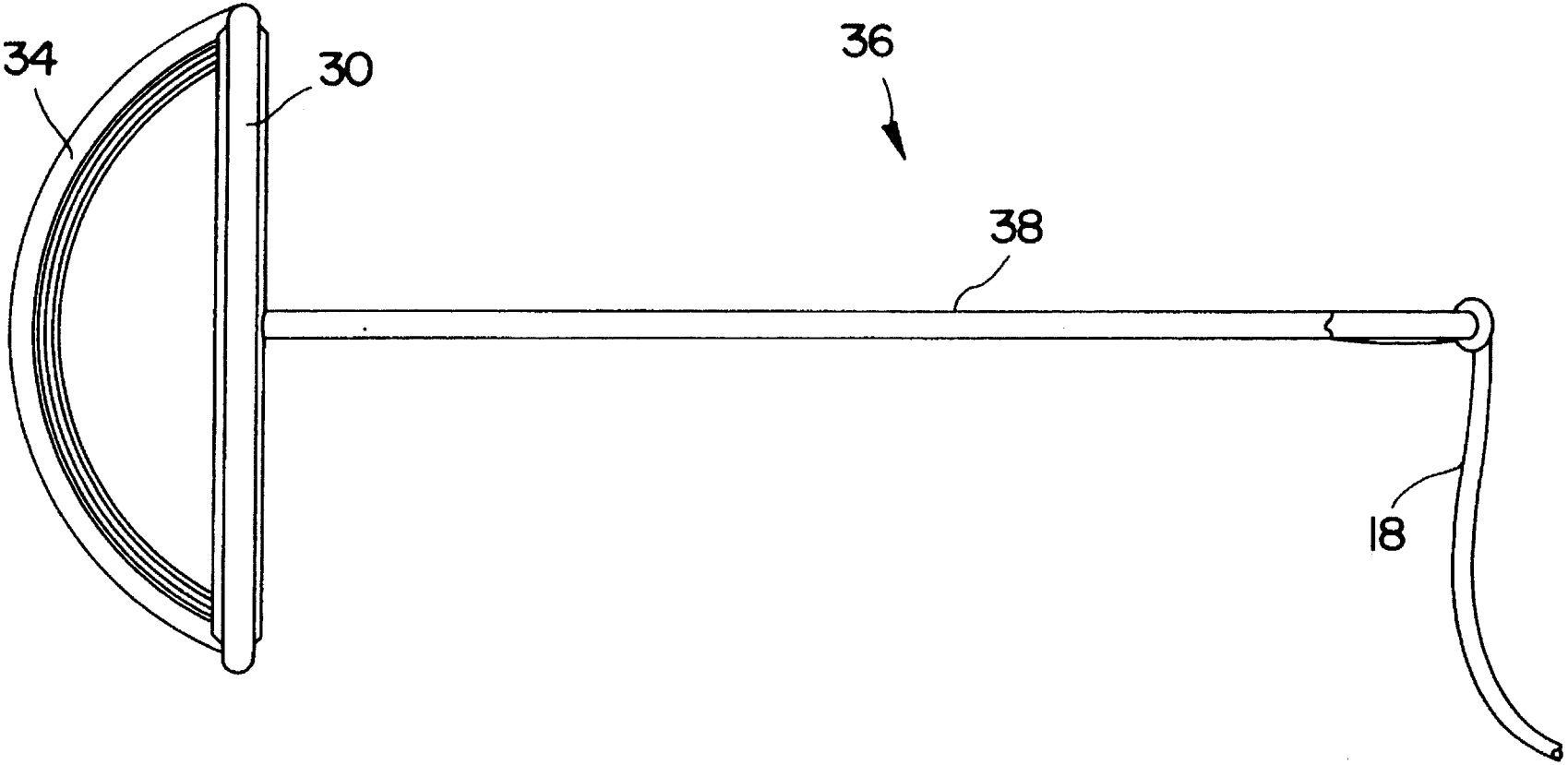
FIG. 5 is a side elevation of the embodiment of FIG. 3.

Referring now to FIGS. 3 through 5, a preferred embodiment of device 16 will be described in detail. Device 16 includes an open frame portion having a pair of longitudinal frame members 26 and 28 extending substantially in parallel as shown. Preferably, longitudinal frame members 26 and 28 are interconnected at their respective ends by a pair of transverse frame members 30 and 32. As shown, the open frame portion preferably has a greater extent in the longitudinal direction of frame members 26 and 28 than in the transverse direction of frame members 30 and 32. This configuration permits golf balls to be received along a relatively wide path as device 16 is dragged.

A plurality of ball catching members 34 are spaced apart along the open frame portion to entrap golf balls while permitting smaller objects, such as small rocks or sticks, to pass therethrough. Specifically, members 34 are preferably spaced by an amount only slightly smaller than the regulation diameter of a typical golf ball. In the exemplary construction illustrated, members 34 are arcuate in shape and extend transversely between longitudinal frame members 26 and 28 as shown. It will be appreciated that longitudinal frame members 26 and 28 thus cover the ends of members 34, which may otherwise resemble tines. As a result, device 16 will have less of a tendency to dig into the soft dirt of bottom 20 or engage relatively immovable objects which may be submerged in water hazard 10.

As shown, tether cord 18 is attached to the "tie end" of an extension portion generally indicated at 36. While the end of extension portion 36 to which tether cord 18 is attached is referred to herein as a "tie end" for convenience, it should be appreciated that such attachment may be accomplished by any suitable means, such as clips or adhesives. Thus, the term "tie end" is to be construed broadly herein as generally referring to the location along extension portion 36 from which tether cord 18 freely extends.

Preferably, the tie end of extension portion 36 is located a predetermined distance from a midpoint location of the longitudinal and transverse directions of the open frame portion. This construction provides device 16 with a number of distinct advantages which are important in the environment in which it will generally be used.

For example, it is often difficult to ensure that the open frame portion will have a desired orientation when it comes to rest on the bottom 20 of water hazard 10. However, because of extension portion 36, the open frame portion will be quickly rotated around to the correct orientation as tether cord 18 is pulled. Extension portion 36 also helps to prevent the open frame portion from digging into the soft dirt of bottom 20 because it prevents the open frame portion from tilting forward by an excessive amount.

In presently preferred embodiments, extension portion 36 comprises an elongated extension member 38 extending perpendicularly from a cross member 40. Cross member 40, on the other hand, extends between longitudinal frame members 26 and 28. Because tether cord 18 is attached by tying in this case, extension member 38 defines a loop 42 at the tie end thereof.

The length of extension member 38 is chosen to place the tie end at the desired predetermined distance from the open frame portion. As discussed above, this predetermined distance should be sufficiently great to quickly rotate the open frame portion as tether cord 18 is pulled, as well as limiting the tilt of the open frame portion during use. A predetermined distance which is too great, however, may also be undesirable. This is because it is generally easier for device 16 to become dislodged from snagged objects when this predetermined distance is shorter. Due to these countervailing considerations, the length of extension member 38 may preferably fall within a range of about eight (8) inches to ten (10) inches.

In presently preferred embodiments, extension portion 36 is configured such that extension member 38 may be easily removable from cross member 40 when device 16 is not in use. When removed, extension member 36 may be placed alongside the open frame portion and tether cord 18 wrapped thereabout to maintain device 16 in a compact arrangement. This arrangement may be easily placed, for example, into one of the outer pockets of a golf bag.

In the illustrated embodiment, removability of extension member 36 is accomplished by threads 44 defined along a portion of the end thereof opposite loop 42. Threads 44 function to threadably engage complementary threads in a bore 46 defined in cross member 40. It should be appreciated, however, that other suitable means of accomplishing removability of extension member 36, such as a snapping arrangement, may also be utilized.

Figure 6:
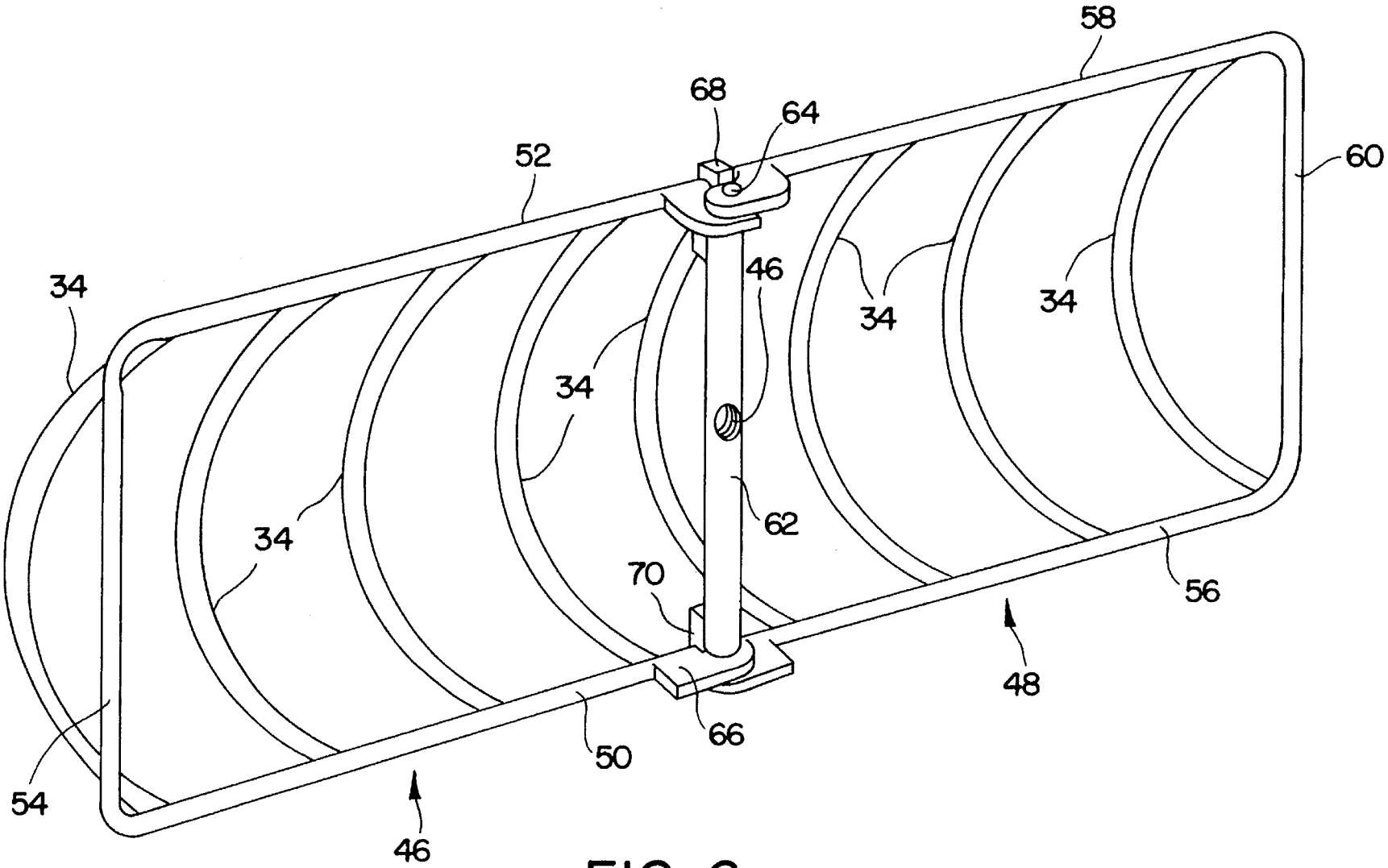
FIG. 6 is a perspective view of another exemplary embodiment of a golf ball retriever device constructed in accordance with the present invention.

FIG. 6 illustrates certain additional features which may be desirable in some applications. In this embodiment, the open frame portion is formed by a pair of generally U-shaped members 46 and 48. U-shaped member 46 is configured having a pair of longitudinal frame members 50 and 52 which are situated substantially in parallel as shown. A side member 54 extends transversely across members 50 and 52 to form a closed end of U-shaped frame member 46. Similarly, U-shaped member 48 is constructed having longitudinal frame members 56 and 58, as well as side member 60.

The open end of each of U-shaped members 46 and 48 is pivotally connected to cross member 62. Although a number of pivot arrangements may be suitable for this purpose, cross member 62 is configured in this case having spindles, such as spindle 64, located at respective ends thereof. These spindles are received in complementary holes defined in hinge portions, such as hinge portion 66, integrally extending from each of the longitudinal frame members.

Figure 7:
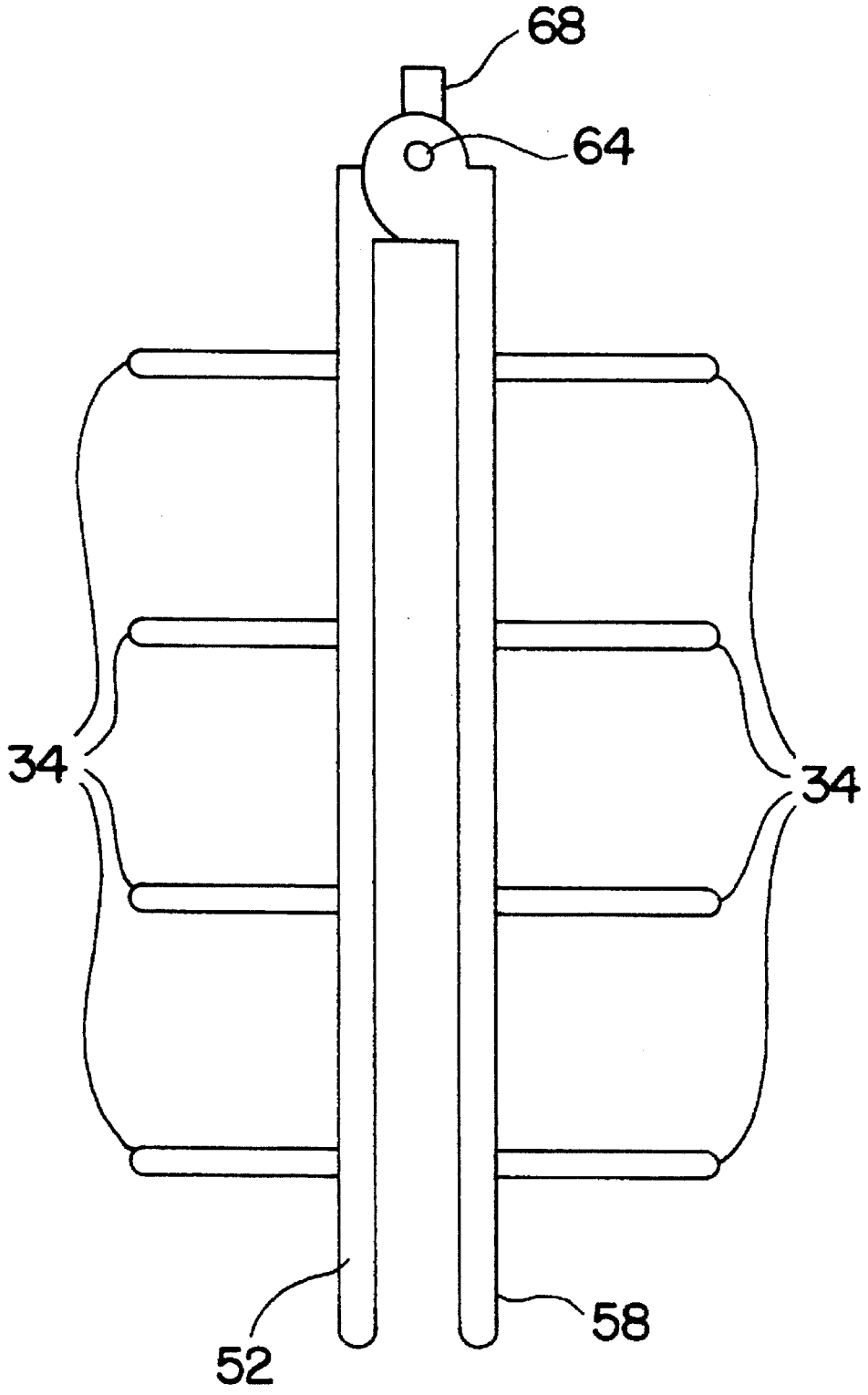
FIG. 7 is a top view illustrating the embodiment of FIG. 6 as it may appear folded for storage.

In FIG. 6, the U-shaped members 46 and 48 are shown unfolded as they may appear during use. It can be seen that U-shaped members 46 and 48 are in alignment so as to functionally form single upper and lower longitudinal frame members, such as longitudinal frame members 26 and 28 discussed above. When folded as shown in FIG. 7, however, U-shaped members 46 and 48 are adjacent one another in a compact arrangement suitable for storage or transport.

In the exemplary construction shown, cross member 62 may be configured having thereon integral tab portions, such as tab portions 68 and 70. Such tab portions are abutted as shown in FIG. 6 by the open end of U-shaped frame members 46 and 48 when unfolded for use. As a result, the open frame portion will be prevented from undesirably pivoting as a unit about cross member 62.

While presently preferred embodiments of the invention have been shown and described, it should be understood that various modifications and variations may be made thereto by those of ordinary skill in the art. For example, extension member 38 may be constructed as a hollow member with tether cord 18 received therein. Additionally, extension portion 36 may be constructed such that extension member 38 pivots at cross member 40 into a retracted position adjacent the open frame portion. Furthermore, in some applications, it may be desirable to utilize a long telescopic pole in lieu of extension member 36 and tether cord 18. Such a telescopic pole may be attached, for example, by insertion of a portion thereof into bore 46.

In addition, it should be understood that aspects of the various embodiments may be interchanged both in whole or in part. Furthermore, those of ordinary skill in the art will appreciate that the foregoing description is by way of example only, and is not intended to be limitative of the spirit and scope of the invention so further set forth in the following claims.

What is claimed is:

1. A golf ball retriever device for recovering golf balls of a predetermined diameter from hazard situations, said device comprising:

an open frame portion having a pair of longitudinal frame members extending substantially in parallel in a longitudinal direction, said open frame portion having a greater extent in the longitudinal direction and a lesser extent in a transverse direction;

a plurality of ball catching members attached to said open frame portion and contained therein such that said longitudinal frame members of said open frame portion define respective first and second running surfaces for said open frame portion, said plurality of ball catching members being spaced by a spacing less than the predetermined diameter of the golf ball;

an extension portion including at least one elongated extension member having an attachment end situated at an axial location substantially at a midpoint of at least the longitudinal direction of said open frame portion and further having a tie end located forwardly of the open frame portion substantially at a predetermined distance from a midpoint location of both the longitudinal and transverse directions of said open frame portion, said predetermined distance being sufficient to maintain said open frame portion substantially upright when at rest on one of said longitudinal frame members; and a tether cord of a predetermined length extending from the tie end of said elongated extension member.

2. A golf ball retriever device as set forth in claim 1, wherein said plurality of ball catching members are arcuate in shape and extend in the transverse direction between said longitudinal frame members.

3. A golf ball retriever device as set forth in claim 2, wherein said open frame portion further includes a pair of transverse frame members located at respective ends of the longitudinal frame members.

4. A golf ball retriever device as set forth in claim 1, wherein said elongated extension member is operatively attached to a cross member extending between said longitudinal frame members.

5. A golf ball retriever device as set forth in claim 4, wherein said tie end of said elongated extension member defines a loop to facilitate attachment of said tether cord thereto.

6. A golf ball retriever device as set forth in claim 4, wherein said elongated extension member is removable from said cross member when not in use.

7. A golf ball retriever device as set forth in claim 6, wherein said elongated extension member defines threads on said attachment end for engagement in a threaded bore defined in said cross member.

8. A golf ball retriever device as set forth in claim 1, wherein said predetermined distance at which said extension member is located from the midpoint of the longitudinal and transverse directions is at least eight (8) inches.

9. A golf ball retriever device as set forth in claim 8, wherein said predetermined distance at which said extension member is located from the midpoint of the longitudinal and transverse directions is no greater than (10) inches.

10. A golf ball retriever device as set forth in claim 1, wherein the predetermined length of the tether cord is at least twenty-five (25) feet.

11. A golf retriever device for recovering golf balls of a predetermined diameter from hazard situations, said device comprising:

a cross member;

a pair of generally U-shaped members having a closed end and an open end, said cross member being pivotally connected across said open end of each of said U-shaped members such that said U-shaped members may be unfolded to form a generally rectangular open frame portion, said open frame portion having a greater extent in a longitudinal direction and a lesser extent in a transverse direction; and a plurality of ball catching members attached to each of said generally U-shaped members such that a periphery of said rectangular open frame portion in the longitudinal direction defines respective first and second tineless running surfaces therefor, said plurality of ball catching members being spaced by spacing less than a predetermined diameter of the golf balls.

12. A golf ball retriever device as set forth in claim 11, wherein said plurality of ball catching members are arcuate in shape and extend in the transverse direction across said U-shaped members.

13. A golf ball retriever device as set forth in claim 11, wherein said cross member has integrally mounted thereon at least one tab abutted by said open end of said U-shaped members when unfolded.

14. A golf ball retriever device as set forth in claim 13, further comprising at least one extension member and a tether cord, said extension member having a first end attached to said cross member and a second end attached to said tether cord.

15. A golf ball retriever device as set forth in claim 14, wherein said elongated extension member defines threads on said first end thereof for engagement in a threaded bore defined in said cross member.

* * * * *